US012768083B2

(12) United States Patent
Iwachido et al.

(10) Patent No.: US 12,768,083 B2
(45) Date of Patent: Oct. 20, 2026

(54) POLYVINYL-ALCOHOL-BASED FIBER, FIBER STRUCTURE, AND METHOD FOR MANUFACTURING SAME

(71) Applicant: Kuraray Co., Ltd., Kurashiki (JP)

(72) Inventors: Naoyuki Iwachido, Kurashiki (JP); Ryokei Endo, Kurashiki (JP); Yoshimi Nonaka, Kurashiki (JP); Osamu Shimabukuro, Kurashiki (JP)

(73) Assignee: Kuraray Co., Ltd., Okayama (JP)

( * ) Notice: Subject to any disclaimer, the term of this patent is extended or adjusted under 35 U.S.C. 154(b) by 605 days.

(21) Appl. No.: 18/258,804

(22) PCT Filed: Dec. 10, 2021

(86) PCT No.: PCT/JP2021/045575
§ 371 (c)(1),
(2) Date: Jun. 21, 2023

(87) PCT Pub. No.: WO2022/138241
PCT Pub. Date: Jun. 30, 2022

(65) Prior Publication Data

US 2024/0301589 A1 Sep. 12, 2024

(30) Foreign Application Priority Data

Dec. 22, 2020 (JP) ..... 2020-211978

(51) Int. Cl.
*D01F 6/14* (2006.01)

(52) U.S. Cl.
CPC ..... *D01F 6/14* (2013.01); *D10B 2401/02* (2013.01); *D10B 2401/063* (2013.01)

(58) Field of Classification Search
CPC ..... D01F 6/14; D01F 6/34; D10B 2401/063; D10B 2401/02; D01D 5/06
See application file for complete search history.

(56) References Cited

U.S. PATENT DOCUMENTS

| | | | | |
|---|---|---|---|---|
| 4,267,016 | A | 5/1981 | Okazaki et al. | |
| 5,455,114 | A * | 10/1995 | Ohmory | D02G 3/406 428/394 |
| 2004/0059055 | A1 * | 3/2004 | Inada | D04H 1/4309 525/326.1 |
| 2019/0380880 | A1 | 12/2019 | Carlsson | |

FOREIGN PATENT DOCUMENTS

| | | | |
|---|---|---|---|
| CN | 1109114 | A | 9/1995 |
| CN | 1495297 | A | 5/2004 |
| EP | 1 394 294 | A1 | 3/2004 |
| JP | 3-14613 | | 1/1991 |
| JP | 10-40898 | A | 2/1998 |
| JP | 2000-136430 | | 5/2000 |
| JP | 2001-262432 | | 9/2001 |
| JP | 2002-235236 | | 8/2002 |
| JP | 2004-293022 | | 10/2004 |
| JP | 2005-194666 | A | 7/2005 |
| JP | 2008-235047 | | 10/2008 |
| JP | 2020-507687 | | 3/2020 |

OTHER PUBLICATIONS

European Search Report received for European Patent Application No. 21910390.0 mailed on Oct. 6, 2025, 10 pages.
Office Action received for Chinese Patent Application No. 202180086818.8, mailed on Nov. 26, 2025, 34 pages with English translation.
Japanese Office Action dated Jan. 23, 2024, in Japanese Application No. 2022-545144, with English translation, 7 pages.
Taiwanese Office Action dated Mar. 4, 2024, in Taiwanese Application No. 110147900, with partial English translation, 11 pages.
Office Action received for Chinese Patent Application No. 202180086818.8, mailed on Apr. 11, 2025, 24 pages with English translation.
Office Action received for Korean Patent Application No. 10-2023-7019402, mailed on Jun. 20, 2025, 10 pages with English translation.
Japanese Office Action dated Aug. 29, 2023, in Japanese Application No. 2022-545144, with English translation, 17pages.
Office Action issue in Taiwanese Patent Application No. 110147900 issued on Jun. 20, 2025, with English translation, 6 pages.
International Search Report issued Mar. 1, 2022, in PCT/JP2021/045575, with English translation, 13 pages.
Decision on rejection issued in Taiwanese Patent Application No. 110147900, dated Feb. 23, 2026, with Machine English translation, 8 pages.
Second Office Action issued in Korean Patent Application No. 10-2023-7019402, dated Feb. 13, 2026, with Machine English translation, 10 pages.
Final Office Action issued in Japanese Patent Application No. JP2024-084324, dated Mar. 31, 2026, with Machine English translation, 9 pages.
Office Action issued in Japanese Application No. JP2024-084324 on Dec. 16, 2025, (with English machine translation), 11 pages.

* cited by examiner

*Primary Examiner* — Mark S Kaucher
(74) *Attorney, Agent, or Firm* — Grüneberg Global IP, PLLC

(57) ABSTRACT

A polyvinyl alcohol fiber that is excellent in water absorption properties, water solubility and mechanical strength; a fiber structure including the polyvinyl alcohol fiber; and a method for producing the polyvinyl alcohol fiber are provided. The polyvinyl alcohol fiber includes 1 mol % or more of at least one functional group selected from a sulfonic acid group, a sulfonate group, a maleic acid group, an itaconic acid group, an acrylic acid group, and a methacrylic acid group. The polyvinyl alcohol fiber has a degree of cross-linking of 0% and a tensile strength of 3 cN/dtex or more.

6 Claims, No Drawings

POLYVINYL-ALCOHOL-BASED FIBER, FIBER STRUCTURE, AND METHOD FOR MANUFACTURING SAME

CROSS-REFERENCE TO RELATED APPLICATIONS

This application is the National Stage entry under § 371 of International Application No. PCT/JP2021/045575, filed on Dec. 10, 2021, and which claims the benefit of priority to Japanese Application No. 2020-211978, filed on Dec. 22, 2020. The content of each of these applications is hereby incorporated by reference in its entirety.

TECHNICAL FIELD

The present invention relates to a polyvinyl alcohol fiber suitable for wound dressing materials, packaging materials and the like, a fiber structure containing the fiber, and a method for producing the fiber.

BACKGROUND ART

Fibrous materials, especially water-retaining and water-absorbing fibers capable of absorbing and retaining liquids, are suitably used as carrier substrates in household products, sanitary products, wound dressing materials used for treating wounds and the like. On the other hand, from the view point that polyvinyl alcohol has excellent water solubility and mechanical strength, since the polyvinyl alcohol dissolves in water when used as a packaging the polyvinyl alcohol is attracting attention from the viewpoint of waste reduction.

However, in polyvinyl alcohol fibers, hydroxyl groups in the polyvinyl alcohol molecules form intramolecular and intermolecular hydrogen bonds, and these bonds are extremely strong. Therefore, since intrusion of water into and between molecules is prevented, morphology hardly changes in water of normal temperature, and the water is hardly absorbed.

Various studies have been made to impart high water absorption properties to the polyvinyl alcohol that is excellent in water solubility and mechanical strength. Further, there is a demand for the polyvinyl alcohol with excellent mechanical strength even in a wet state as well as excellent water retention characteristics and water absorption properties.

For example, Patent Document 1 describes a polyvinyl alcohol fiber in which a cross-linking component is introduced into polyvinyl alcohol. The polyvinyl alcohol described in Patent Document 1 has a fiber strength necessary for obtaining a fiber structure such as a non-woven fabric despite its high water absorption performance.

Patent Document 2 discloses a fibrous material comprising a drug containing at least one group capable of forming a hydrogen bond with crosslinked polyvinyl alcohol. Patent Document 2 describes a crosslinked polyvinyl alcohol fiber that has excellent mechanical strength even under damp or wet conditions and has excellent water absorption properties.

However, since the polyvinyl alcohol fibers described in Patent Documents 1 and 2 have a cross-linking component, a part of the fibers may become insoluble in water, and a disposal process may become complicated.

Moreover, when a cross-linking agent is used to introduce a cross-linked structure, the use of the polyvinyl, alcohol fiber may be limited depending on the type of the cross-linking agent.

PRIOR ART DOCUMENT

Patent Document

Patent Document 1: JP-A 2004-293022
Patent Document 2: JP-A 2020-507687

SUMMARY OF THE INVENTION

Problem to be Solved by the Invention

An object of the present invention is to provide a polyvinyl alcohol fiber that is excellent in water absorption properties, water solubility and mechanical strength. Another object of the present invention is to provide a fiber structure having the polyvinyl alcohol fiber at least in part, and a method for producing the polyvinyl alcohol fiber.

Means for Solving the Problem

That is, the present invention relates to:

[1] A polyvinyl alcohol fiber comprising 1 mol % or more of at least one functional group selected from the group consisting of a sulfonic acid group, sulfonate group, a maleic acid group, an itaconic acid group, an acrylic acid group and a methacrylic acid group, wherein the polyvinyl alcohol fiber has a degree of cross-linking of 0% and a tensile strength of 3 cN/dtex or more.

Further, as a preferred embodiment of the present invention, the present invention relates to:

[2] The polyvinyl alcohol fiber in the above-mentioned item [1], wherein the polyvinyl alcohol fiber has a water absorption ratio of 5 times or more after being immersed in physiological saline at 30° C. for 1 hour.

[3] The polyvinyl alcohol in fiber the above-mentioned item [1] or [2], wherein the polyvinyl alcohol fiber has a dissolution temperature in physiological saline or water of 80° C. or less.

[4] The polyvinyl alcohol fiber in any one of the above-mentioned items [1] to [3], wherein the polyvinyl alcohol fiber has a degree of saponification of 95 mol % or more.

[5] The polyvinyl alcohol fiber in any one of the above-mentioned items [1] to [4], wherein the polyvinyl alcohol fiber has a crystallinity of 20 to 50%.

Further, the present invention relates to:

[6] A fiber structure comprising the polyvinyl alcohol fiber in any one of the above-mentioned items [1] to [5] at least in part.

Furthermore, the present invention relates to:

[7] A method for producing the polyvinyl alcohol fiber in any one of the above-mentioned items [1] to [5], the method comprising:

wet or dry-wet spinning a spinning stock solution containing polyvinyl alcohol in a solidifying bath mainly composed of an organic solvent capable of solidifying the polyvinyl alcohol to obtain a fiber, the polyvinyl alcohol comprising 1 mol % or more of at least one functional group selected from the group consisting of a sulfonic acid group, a sulfonate group, a maleic acid group, an itaconic acid group, an acrylic acid group and a methacrylic acid group, wherein in any step of drying, stretching or heating the fiber, a total stretching ratio of the fiber in all processes is 3 times or more.

DETAILED DESCRIPTION OF THE INVENTION

Effects of the Invention

According to the present invention, it is possible to provide a polyvinyl alcohol fiber that is excellent in water absorption properties, water solubility and mechanical strength, a fiber structure containing the same at least in part, and a method for producing the polyvinyl alcohol fiber.

Mode for Carrying Out the Invention

In the present invention, by using a polyvinyl alcohol fiber comprising 1 mol % or more of at least one functional group selected from the group consisting of a sulfonic acid group, a sulfonate group, a maleic acid group, an itaconic acid group, an acrylic acid group and methacrylic acid group, having a degree of cross-linking of 0% and a tensile strength of 3 cN/dtex or more, it is possible to obtain a fiber that is excellent in water absorption properties, water solubility and mechanical strength.

The maleic acid group is a residue obtained by removing hydrogen other than a hydroxyl group from maleic acid, and the removed hydrogen is not particularly limited as long as it is other than the hydroxyl group. The same applies to the itaconic acid groups, the acrylic acid groups and the methacrylic acid groups.

In the present invention, the polyvinyl alcohol fiber has the functional group described above, and the polyvinyl alcohol fiber may be composed of one kind of polyvinyl alcohol or two or more kinds of polyvinyl, alcohols, but preferably composed of the one kind of polyvinyl alcohol. Further, other polymers than the polyvinyl alcohol may be included therein. When the polyvinyl alcohol fiber is composed of the two or more kinds of polyvinyl alcohol, or when the polyvinyl alcohol fiber contains another polymer, an amount of the functional group contained in an entire polyvinyl alcohol fiber may be within the above range.

The functional group contained in the polyvinyl alcohol fiber of the present invention is the at least one selected from the group consisting of the sulfonic acid group, the sulfonate group, the maleic acid group, the itaconic acid group, the acrylic acid group and the methacrylic acid group. The polyvinyl alcohol fiber can be produced by spinning the polyvinyl alcohol having these functional groups. Examples of a method for producing the polyvinyl alcohol having the functional group described above include a method of copolymerizing a monomer having these functional groups and a vinyl ester monomer and saponifying a resulting polyvinyl copolymer, or a method of introducing these groups functional into preliminarily synthesized polyvinyl alcohol later or the like.

A monomer containing the sulfonic acid group or the sulfonate group is a monomer that can be copolymerized with a vinyl ester to form the sulfonic acid group or the sulfonate group which is a salt of the sulfonic acid group after saponification. Specifically, examples of such monomers include 2-acrylamido-2-methylpropanesulfonic acid or its metal alkali salts, 2-acrylamido-1-methylpropanesulfonic acid or its alkali metal salts, 2-methacrylamide-2-methylpropanesulfonic acid or its alkali metal salts, olefinsulfonic acids such as ethylenesulfonic acid, allylsulfonic acid, methallylsulfonic acid or its metal salts, and the like. Among them, the 2-acrylamido-2-methylpropanesulfonic acid or its alkali metal salts is preferable from the viewpoint of reactivity with vinyl ester and stability during saponification.

The sulfonic acid group or the sulfonate group may be subsequently introduced into the polyvinyl alcohol. For example, preliminarily synthesized polyvinyl alcohol may be dissolved in an organic solvent such as dimethylsulfoxide and reacted with an aromatic aldehyde sulfonic acid such as sodium orthobenzaldehyde sulfonate or its salts so that a hydroxyl group portion of the polyvinyl alcohol is modified with the sulfonic acid group or its metal salts.

At this time, an aromatic sulfonic acid such as p-toluenesulfonic acid may be used as a catalyst.

A monomer containing the maleic acid group is a monomer that can be copolymerized with the vinyl ester and where the maleic acid group is present in the resulting copolymer. Specifically, examples of such monomers include maleic acid or esters as its salts, maleic acid such monomethyl maleate, dimethyl maleate, monoethyl maleate and diethyl maleate, maleic anhydride and its derivatives, and the like. Among them, the maleic acid, the monomethyl maleate, and the dimethyl maleate are preferable from the viewpoint of copolymerization reaction with vinyl ester and stability during saponification.

A monomer containing the itaconic acid group is a monomer that can be copolymerized with the vinyl ester and where the itaconic acid group is present in the resulting copolymer. Specifically, examples of such monomers include itaconic acid or its salts, itaconic acid esters such as monomethyl itaconate, dimethyl itaconate, monoethyl itaconate and diethyl itaconate, itaconic anhydride and its derivatives, and the like. Among them, the itaconic acid, the monomethyl itaconate, and the dimethyl itaconate are preferable from the viewpoint of copolymerization reaction with vinyl ester and stability during saponification.

A monomer containing the acrylic acid group is a monomer that can be copolymerized with the vinyl ester and where the acrylic acid group is present in the resulting copolymer. Specifically, examples of such monomers include acrylic acid or its salts, and acrylic acid esters such as methyl acrylate, ethyl acrylate, n-propyl acrylate and isopropyl acrylate. Among them, the acrylic acid and the methyl acrylate are preferable from the viewpoint of copolymerization reaction with vinyl ester and stability during saponification.

A monomer containing the methacrylic acid group is a monomer that can be copolymerized with the vinyl ester and where the methacrylic acid group is present in the resulting copolymer. Specifically, examples of such monomers include methacrylic acid or its salts, and methacrylic acid esters such as methyl methacrylate, ethyl methacrylate, n-propyl, methacrylate and isopropyl methacrylate. Among them, the methacrylic acid and the methyl methacrylate are preferable from the viewpoint of copolymerization reaction vinyl ester and stability during saponification.

One kind or two or more kinds of the monomers having these functional groups described above may be used, but it is preferable to use the one kind of monomer.

Examples of vinyl ester monomers to be copolymerized include vinyl formate, vinyl acetate, vinyl propionate, vinyl valerate, vinyl laurate, vinyl stearate, vinyl benzoate, vinyl pivalate, and vinyl versatate. Among these, the vinyl acetate is preferred.

One kind or two or more kinds of vinyl ester monomers may be used, but it is preferable to use one kind of vinyl ester monomer.

The polyvinyl alcohol having at least one functional group selected from the group consisting of the sulfonic acid group, the sulfonate group, the maleic acid group, the itaconic acid group, the acrylic acid group and the methacrylic acid group is obtained by the method described above. In the case of production by copolymerization, a content of the functional group in the polyvinyl alcohol obtained can be adjusted by appropriately adjusting the amount of the monomer during copolymerization.

When these functional groups are subsequently introduced into the polyvinyl alcohol, a desired functional group content can be achieved by adjusting the amount of the polyvinyl alcohol and the amount of the compound having the functional group.

The content of such functional groups is 1 mol % or more in the polyvinyl alcohol. From the viewpoint of water absorption properties, it is preferably 1.5 mol % or more, and more preferably 2 mol % or more. If the content is too low, the water absorption properties cannot be maintained.

From the viewpoint of cost, processability, and yarn quality, the content of the functional group is preferably 20 mol % or less, more preferably 10 mol % or less, and even more preferably 6 mol % or less.

When the polyvinyl alcohol fiber is composed of two or more kinds of polyvinyl alcohol and when it contains another polymer, amount of the functional group contained in each polyvinyl alcohol may be adjusted so that the amount of the functional group contained in the finally obtained polyvinyl alcohol fiber falls within the above range.

The polyvinyl alcohol used in the present invention may contain functional groups other than the sulfonic acid group, the sulfonate group, the maleic acid group, the itaconic acid group, the acrylic acid group and the methacrylic acid group and may be modified with other components as long as the effects of the present invention are not impaired. Examples of a method of containing other functional groups or a method of modifying with other components include a method of copolymerizing a monomer such as allylsulfonic acid, vinylpyrrolidone, or ethylene with the vinyl ester monomer.

A degree of cross-linking of the polyvinyl alcohol used in the present invention is 0%. When the degree of cross-linking is 0%, the fiber is less likely to become insoluble in water, and even if they become insoluble, there is little effect on disposal.

The polyvinyl alcohol fiber with the degree of cross-linking of 0% can be obtained by forming a fiber using the polyvinyl alcohol described above. As a method for setting the degree of cross-linking to 0%, there is a method such as not using a cross-linking agent.

The degree of cross-linking can be measured by the following method.

A measurement sample and a 1N hydroxylammonium chloride aqueous solution of 100 times the mass of the sample are added to a test tube, sealed, and then dissolved at 121° C. for 2 hours. Thereafter, the resulting solution is titrated with 0.1N NaOH aqueous solution until a pH reaches that of 1N hydroxylammonium chloride aqueous solution, and the degree of cross-linking is calculated from a titration amount by the following formula.

$$\text{Degree of Cross-linking (mol \%)} = [\text{neutralized alkali amount (mol \%)}/(\text{PVA mass (g)}/44)] \times ½$$

PVA mass: a mass of the polyvinyl alcohol fiber for measuring the degree of cross-linking A degree of polymerization (viscosity average polymerization degree) of the polyvinyl alcohol used in the present invention is not particularly limited, but from the viewpoint of mechanical strength and suppression of fiber insolubilization due to shrinkage and gelation when dissolved in water, the degree of polymerization of the polyvinyl alcohol is preferably 2400 or less, and more preferably 1800 or less. If the degree of polymerization is too high, treatment with high temperature water or immersion in water for a long time may be required. In addition, from the viewpoint of suppressing deterioration of spinnability and adhesion between the fibers and maintaining mechanical properties and quality of the fiber and the fiber structure, the degree of polymerization is preferably 500 or more, more preferably 700 or more, and particularly preferably 1000 or more.

A water absorption ratio of the polyvinyl alcohol fiber is preferably 5 times or more, more preferably 8 times or more, and even more preferably 10 times or more after being immersed in physiological saline at 30° C. for 1 hour. An upper limit value of the water absorption ratio is not particularly limited, but may be 50 times or less.

The physiological saline includes, for example, 0.01 mol/L phosphate buffered saline. A predetermined amount of the polyvinyl alcohol fiber is weighed, immersed in the above physiological saline for 1 hour, and then the liquid is removed. After that, the water absorption ratio can be obtained from the following formula from the weight change rate of the polyvinyl alcohol fiber before and after immersion.

$$\text{Water absorption ratio (times)} = (B)/(A)$$

(A): a mass of polyvinyl alcohol fiber before immersion (B): a mass of polyvinyl alcohol-based fiber after immersion A tensile strength of the polyvinyl alcohol fiber of the present invention is 3 cN/dtex or more, and preferably 4 cN/dtex or more. An upper limit value of the tensile strength is not particularly limited, but it may be 25 cN/dtex or less.

The tensile strength of the polyvinyl alcohol fiber can be adjusted to the desired tensile strength by controlling stretching conditions such as a stretching temperature and a stretching ratio in a method for producing the fiber described later.

From the viewpoint of the water solubility, a dissolution temperature of the polyvinyl alcohol fiber of the present invention in physiological saline or water is preferably 80° C. or lower, and more preferably 50° C. or lower. A lower limit value of the dissolution temperature in physiological saline or water is not particularly limited, but it may be 0° C. or higher. The dissolution temperature of the polyvinyl alcohol fiber in physiological saline or water can be controlled by the degree of polymerization, a degree of saponification, the kind and content of the functional group and the like of the polyvinyl alcohol constituting the fiber. In addition, from the viewpoint of suppressing the deterioration of the water solubility due to gelation when dissolved in water and ensuring high water solubility, the fiber having a small shrinkage rate when dissolved in water is preferable, and specifically, the fiber having a maximum shrinkage rate (shrinkage rate in water) when dissolved in water is 30% or less, particularly preferably 10% or less.

The degree of saponification of the polyvinyl alcohol fiber of the present invention is preferably 95 mol % or more. If the degree of saponification is less than the above range, the polyvinyl alcohol obtained and the polyvinyl alcohol fiber obtained therefrom may be inferior in mechanical strength and, for example, may be impractical when used as a package. The degree of saponification is usually 100 mol % or less, preferably 99.5 mol % or less, and more preferably 98 mol % or less.

As described above, the polyvinyl alcohol fiber of the present invention may contain one kind or two or more kinds of polyvinyl alcohols. When the one kind of polyvinyl alcohol is used, the polyvinyl alcohol having the degree of saponification within the above range can be spun by the method described later to obtain the intended polyvinyl alcohol fiber.

When the two or more kinds of polyvinyl alcohols are used, the degree of saponification of each polyvinyl alcohol has additivity, so the degree of saponification of each polyvinyl alcohol is determined in advance by measurement or the like. Then, the degree of saponification of the entire polyvinyl alcohol fiber obtained by the following formula (1) is determined, and the blending amount of the polyvinyl alcohols used may be adjusted so that the obtained degree of saponification falls within the above range.

The degree of saponification of polyvinyl alcohol can usually be determined by the method described in JIS K 6726.

$$\text{Degree of saponification (mol \%) of polyvinyl alcohol fiber} = \Sigma(ni \times Mi)/100 \quad \text{[Equation 1] (1)}$$

ni: a degree of saponification of each polyvinyl alcohol (mol %)

Mi: a proportion of each polyvinyl alcohol in the polyvinyl alcohol fiber (% by mass)

When the polyvinyl alcohol fiber contains a polymer other than the polyvinyl alcohol, In the above formula (1), for the polymer other than the polyvinyl alcohol, the ratio of the polymer other than the polyvinyl alcohol may be substituted for Mi, and 0 (zero) may be substituted for ni.

From the viewpoint of the water solubility, a crystallinity of the polyvinyl alcohol fiber of the present invention is preferably 50% or less, and more preferably 40% or less. From the viewpoint of fiberization and mechanical strength, the crystallinity of the polyvinyl alcohol fiber of the present invention is preferably 20% or more, and more preferably 30% or more.

The degree of crystallinity can be controlled by the degree of polymerization, the degree of saponification, and the kind and content of the functional group of the polyvinyl alcohol that constitutes the polyvinyl alcohol fiber.

When the polyvinyl alcohol fiber of the present invention is composed of two or more kinds of the polyvinyl alcohol, examples of the polyvinyl alcohol fiber include:

(1) Polyvinyl alcohol fiber composed of two or more kinds of polyvinyl alcohol (hereinafter sometimes referred to as polyvinyl alcohol (A)) having at least one functional group selected from the group consisting of the sulfonic acid group, the sulfonate group, the maleic acid group, the itaconic acid group, the acrylic acid group and the methacrylic acid group, (2) Polyvinyl alcohol fiber composed of the polyvinyl alcohol (A) and polyvinyl alcohol having no functional group described above (hereinafter sometimes referred to as polyvinyl alcohol (B)).

When the polyvinyl alcohol fiber of the present invention contains a polymer other than polyvinyl alcohol, examples of the polyvinyl alcohol fiber include:

(3) Polyvinyl alcohol fiber composed of the polyvinyl alcohol (A), the polyvinyl alcohol (B) and the polymer other than the polyvinyl alcohol, or polyvinyl alcohol fiber composed of the polyvinyl alcohol (A) and the polymer other than the polyvinyl alcohol fiber.

In the item (1) described above, a plurality kinds of polyvinyl alcohols (A) differ in at least one of the kind of the functional group, the content, the degree of saponification, and the degree of polymerization. In the item (2), the degree of saponification and the degree of polymerization of the polyvinyl alcohol (A) and the polyvinyl alcohol (B) may be different or the same.

The polyvinyl alcohol (A) has at least 1 mol % of at least one functional group selected from the group consisting of the sulfonic acid group, the sulfonate group, the maleic acid group, the itaconic acid group, the acrylic acid group and the methacrylic acid group. More preferably, the amount of the functional group is 2 mol % or more. Moreover, the amount of the functional group is usually 20 mol % or less.

The degree of polymerization of polyvinyl alcohol (A) is preferably 2400 or less, and more preferably 1800 or less, as described above. Further, the degree of polymerization is preferably 500 or more, more preferably 700 or more, and particularly preferably 1000 or more.

In addition to the above, other commonly used additives may be added to the polyvinyl alcohol fiber of the present invention. When added, the content of the polyvinyl alcohol in the polyvinyl fiber alcohol is preferably 60% by mass or more, and particularly preferably 70 to 99% by mass.

When producing the polyvinyl alcohol fiber of the present invention, spinning first, stock solution containing the polyvinyl alcohol satisfying the above requirements is prepared. A solvent constituting the spinning stock solution may be water, but it is preferable to use an organic solvent as the constituent solvent of the spinning stock solution because it is possible to obtain the uniform fiber with high mechanical properties and dimensional stability and a substantially circular cross section and the dissolution temperature in water can be lowered compared to the case where the water is used as the solvent for the spinning stock solution.

Examples of organic solvents include polar solvents such as dimethyl sulfoxide (hereinafter sometimes referred to as DMSO), dimethylacetamide, dimethylformamide and N-methylpyrrolidone, polyhydric alcohols such as glycerin and ethylene glycol, mixtures of these with swelling metal salts such as rhodan salts, lithium chloride, calcium chloride and zinc chloride, and mixtures of these solvents with each other, or with these solvents and water, and the like. Among them, DMSO is most preferable in terms of low-temperature solubility, low toxicity, low corrosiveness and the like.

A polymer concentration in the spinning stock solution varies depending on the composition, the degree of polymerization and the solvent, but is generally in the range of 8 to 40% by mass. When the constituent solvent of the spinning stock solution is organic an solvent, dissolution is preferably carried out while stirring under reduced pressure after purging with nitrogen from the viewpoint of preventing oxidation, decomposition, cross-linking reaction or the like and suppressing foaming. A liquid temperature at the time of discharging the spinning stock solution is preferably in the range of 50 to 150° C. so that the stock solution does not gel, decompose or color.

When the polyvinyl alcohol fiber of the present invention is composed of the polyvinyl alcohol, the solvent is used to prepare a polyvinyl alcohol spinning stock solution. When the polyvinyl alcohol fiber is composed of two or more kinds of polyvinyl alcohols, the two or more kinds of polyvinyl alcohols may be mixed in advance when preparing the spinning stock solution and the above solvent may be used as the spinning stock solution, or each solution containing each polyvinyl alcohol may be prepared using the above solvent, and then the solutions may be mixed to form a spinning stock solution.

The polyvinyl alcohol fiber of the present invention can be produced by spinning the spinning stock solution prepared and adjusted as described above. A spinning method is not particularly limited, and examples thereof include a dry spinning method, a wet spinning method, and a dry-wet spinning method. Among them, the wet spinning method or the dry-wet spinning method is preferable because of its high productivity, and a solidification liquid capable of solidifying the polyvinyl alcohol may be discharged. In particular, when the spinning stock solution is discharged from multiple holes, the wet spinning method is preferable to the dry-wet spinning method from the viewpoint of preventing the fibers from sticking together during discharge. In this regard, the wet spinning method is a method in which the spinning stock solution is discharged directly from the spinneret into a solidifying bath, while the dry-wet spinning method is a method in which the spinning stock solution is once discharged from the spinneret into air or an inert gas and then introduced into the solidifying bath. Further, the term "solidifying (solidification)" as used in the present invention refers to transformation of a fluid spinning stock solution into a non-fluid solid, including both gelation in which the composition of the spinning stock solution does not change and solidification in which the composition of the spinning stock solution changes.

When the constituent solvent of the spinning stock solution is water, for example, a saturated mirabilite solution may be discharged as the solidification liquid. Further, when the constituent solvent of the spinning stock solution is an organic solvent, for example, alcohols such as methanol, ethanol, propanol and butanol, ketones such as acetone, methyl ethyl ketone and methyl isobutyl ketone, fatty acid esters such as methyl acetate and ethyl acetate, aromatics such as benzene and toluene, or a mixture of two or more thereof may be discharged as the solidified liquid. In order to sufficiently solidify an inside of the fiber, it is preferable to use a solidifying solvent mixed with the constituent solvent of the spinning stock solution, and the mixing mass ratio of the solidifying solvent/the constituent solvent is preferably 95/5 to 40/60, more preferably 90/10 to 50/50, and even more preferably 85/15 to 55/45. Further, by mixing the constituent solvent in the solidifying bath, it possible is to adjust the solidification ability reduce and the separation and recovery cost of the constituent solvent and the solidified solvent. A temperature of the solidifying bath is not limited, but the solidification is usually carried out at the temperature of the solidifying bath of −15 to 30° C. when the constituent solvent of the spinning stock solution is an organic solvent. From the viewpoint of uniform solidification and energy saving, the temperature of the solidifying bath is preferably −10 to 20° C., more preferably −5 to 15° C., and particularly preferably 0 to 10° C. If the temperature of the solidifying bath is outside this temperature range, the tensile strength of the obtained fiber may be lowered. When the spinning stock solution is heated to a high temperature, it is preferable to cool the solidifying bath in order to keep the solidifying bath temperature low.

Then, wet stretching may be applied to the fiber after being removed from the solidifying bath as needed. From the viewpoint of the mechanical properties of the fiber and the prevention of sticking, it is preferable to apply the wet stretching of 1.5 to 7 times, particularly 2.5 to 5.5 times, and in order to suppress sticking of fibers, it is preferable to increase the wet stretching ratio within a range in which fluff does not occur. In order to increase the wet stretching ratio, it is effective to carry out the wet stretching in two or more stages during a extraction step.

When the constituent solvent of the spinning stock solution is an organic solvent, it is preferable to extract and remove the constituent solvent from the fiber by bringing it into contact with an extraction bath mainly containing a solidifying solvent. Further, wet stretching and extraction may be performed in the same step. This extraction treatment can shorten a residence time in the extraction bath by continuously flowing the pure solidifying solvent in the direction countercurrent to the running direction of the fiber. By this extraction treatment, the amount of the constituent solvent of the spinning stock solution contained in the fiber can be reduced to 18 by mass or less, particularly 0.18 by mass or less of the mass of the fiber, and thus such a method is preferable. The contact time is preferably 5 seconds or more, and particularly preferably 15 seconds or more. In order to increase the extraction speed the and improve it extraction, is preferable to loosen the fibers in the extraction bath. In addition, prior to drying, it is also effective to prevent sticking by replacing the constituent solvent of the spinning stock solution solvent with a having high solidifying ability with respect to the polyvinyl alcohol, such as ketones such as acetone, methyl ethyl ketone and methyl isobutyl ketone, by adhering hydrophobic oils such as mineral oils, polyethylene oxides, silicon oil and fluorine oil in the form of solutions or emulsions, and by shrinking in order to relax shrinkage stress during drying.

The fiber may then be dried, preferably at 180° C. or less, and the mechanical properties of the fiber can be enhanced by further dry heat stretching. Dry heat treatment conditions can be appropriately selected according to the properties of the polyvinyl alcohol, particularly the melting point and the desired dissolution temperature in water, but the stretching ratio of the dry heat stretching is preferably about 1.1 to 10 times, and a dry heat From stretching temperature is preferably 100 to 220° C. the viewpoint of processability and the effect of the dry heat stretching and/or dry heat treatment, the temperature is preferably from 120 to 200° C., and more preferably from 140 to 180° C. From the viewpoint of efficient stretching by suppressing agglutination between fibers, it is preferable to perform the dry heat stretching in multiple stages of 2 times or more, and it is particularly preferable to perform the dry heat stretching in multiple stages at elevated temperature.

From the viewpoint of the crystallinity of the polyvinyl alcohol fiber to be obtained, it is preferable to set the total stretching ratio to 3 times or more in any one of the drying, stretching and heating steps.

A fineness of the single fiber of the polyvinyl alcohol fiber of the present invention is not particularly limited, but the fiber having the fineness of 0.1 to 1000 dtex, preferably 0.2 to 100 dtex, and more preferably 0.5 to 10 dtex can be widely used. A fiber length of the fiber may be appropriately set according to the application, but when processing into paper or spun yarn, for example, the fiber length is preferably about 1 to 100 mm. Further, there is no particular limitation on the cross-sectional shape of the polyvinyl alcohol fiber, but a simple substantially circular fiber is preferable to a complicated shape from the viewpoints of water dispersibility and product homogeneity.

The polyvinyl alcohol fiber of the present invention is excellent in various properties such as mechanical properties, and any structure be fiber can obtained by using this fiber. For example, it can be processed into cut fibers, filaments, spun yarns, fabrics such as woven or knitted fabrics or dry non-woven fabrics, and fiber structures such as ropes and cords. Among them, fabrics, especially non-woven fabrics, and especially dry non-woven fabrics are more preferable because they are excellent in mechanical properties, flexibility and the like. Further, such a fabric may be formed into a desired shape. At this time, other fibers may be used in combination, but from the viewpoint of efficiently obtaining the effects of the present invention, the polyvinyl alcohol fiber of the present invention preferably accounts for 408 by mass or more, more preferably 60% by mass or more, particularly preferably 80 to 100% by mass of the fiber structure. The other fibers include water-soluble fibers, water-insoluble fibers and polyvinyl alcohol fibers other than those of the present invention. It may also be used in combination with other materials such as metals or films.

The polyvinyl alcohol fiber and the fiber structure of the present invention can be used for various purposes and can be used particularly suitably for wound dressing materials, packaging materials for soaps, detergents, bleaches and the like, salt-free binders for non-woven glass fabrics, and disposable diaper members due to high water absorption properties thereof.

When the fiber structure of the present invention is used as a wound dressing material, it is preferable to use at least fabric from the viewpoint of mechanical properties, flexibility, water retention characteristics, packaging properties and the like. The basis weight of such fabric is preferably 50 g/m$^2$ or more, and particularly preferably 100 g/m$^2$ or more from the viewpoint of the mechanical properties and the water retention characteristics and is preferably 300 g/m$^2$ or less, more preferably 200 g/m$^2$ from the viewpoint of production efficiency and the flexibility. Further, a breaking length of the fabric is preferably 5 N/25 cm or more from the viewpoint of the mechanical properties.

When the fiber structure of the present invention is used as a packaging material, it is preferable to use at least fabric from the viewpoint of mechanical properties, flexibility, water retention characteristics, packaging properties and the like. Non-woven fabrics are particularly preferable from the viewpoints of production processability, cost, solubility in water and the like. The basis weight of fabric such is preferably 10 g/m$^2$ or more, and particularly preferably 40 g/m$^2$ or more from the viewpoint of mechanical properties and packaging properties and is preferably 80 g/m$^2$ or less, and more preferably 60 g/m$^2$ from the viewpoint of the production efficiency and the flexibility. Further, the breaking length of the fabric is preferably 5 N/25 cm or more from the viewpoint of the mechanical properties.

A method for producing such fabric is not particularly limited, but it is preferable to use a dry non-woven fabric obtained by treating a fiber web from the viewpoint of feeling, flexibility, and the like. As a method for producing the dry non-woven fabric, for example, a method in which polyvinyl alcohol fiber filaments are opened by a repulsive action due to triboelectrification is preferably used. Further, a method in which crimped or cut staples or the like are opened with a card or the like to form a web and then an area compression rate of 10 to 50%, particularly preferably 10 to 30%, that is, 10 to 50%, particularly preferably 10 to 50% of a surface area of the non-woven fabric is thermally pressed with a hot embossing roller is also preferably used. By subjecting a portion of the non-woven fabric to a thermocompression bonding treatment, the mechanical properties and shape stability can be enhanced without impairing the feeling, flexibility and water solubility of the non-woven fabric. An area of each thermocompression bonding portion is preferably 4 cm$^2$ or less, more preferably 2 cm$^2$ or less, even more preferably 1 cm$^2$ or less from the viewpoint of the feeling, water solubility and the like, and preferably 1 mm$^2$ or more from the viewpoint of the mechanical properties of the non-woven fabric. A thermocompression bonding temperature may be, for example, about 120 to 230° C. and a thermocompression bonding pressure may be about 1 to 6 MPa. In addition, since the polyvinyl alcohol fiber of the present invention expresses adhesion ability by dry heat treatment, such an embossing treatment can bond the fibers to efficiently enhance the mechanical properties of the non-woven fabric, and the thermocompression bonding treatment can easily form the non-woven fabric into a desired shape. For example, it may be molded into a desired shape such as bag-like or box-like. As the packaging material, a bag-like material can be preferably used. For example, the bag-like material having a side of about 3 to 10 cm may be used.

Another method for producing the dry non-woven fabric is, for example, a method of producing the non-woven fabric by entangling by needle punching. In this case, by using a known needle punch machine and adjusting conditions such as needle density, needle type, needle depth and number of punches according to the properties of the fiber, the dry non-woven fabric with excellent strength and flexibility can be produced. If desired, entanglement may be optimized through multiple needle punch machines.

EXAMPLES

The present invention will be described in more detail below with reference to examples, but the present invention is not limited to these examples.

[Degree of Polymerization]

Based on JIS K 6726, the degree of polymerization was calculated by the following formula (1) from the measured value of the intrinsic viscosity [η] of an aqueous solution at 30° C. In this regard, P is an average degree of polymerization of the polyvinyl alcohol.

$$\log P = 1.613 \cdot \log([\eta] \times 10^4/8.29) \quad (1)$$

[Degree of Saponification (Mol %)]

Measured according to JIS K 6726.

[Tensile Strength (cN/dtex)]

Measured according to JIS L 1013.

[Crystallinity of Polyvinyl Alcohol Fiber]

Using a Mettler differential scanning calorimeter (DSC-20), an endothermic amount ΔH (J/g) at an endothermic peak was measured when 10 mg of the fiber sample was heated at a rate of 20° C./min under nitrogen. Next, the degree of crystallinity was calculated by the following formula (2) from a ratio to 174.5 J/g, which is the heat of fusion of complete crystals of the polyvinyl alcohol.

$$\text{Crystallinity } (\%) = \Delta H(\text{J/g})/174.5(\text{J/g}) \times 100 \quad (2)$$

[Dissolution Temperature of Fiber in Water (° C.)]

0.02 g of the fiber cut into a length of 2 mm was held in water, the water temperature was raised at a rate of 2° C./min, and the temperature at which the fiber dissolved was taken as the dissolution temperature in water.

[Water Absorption Ratio of Fiber]

The fibers were precisely weighed and immersed in physiological saline (0.01 mol/L phosphate buffered saline) at 30° C. for 1 hour. After that, the liquid was drained by leaving it for 10 minutes, and the mass was measured. When the mass of the fiber before immersion in physiological saline is A (g) and the mass after immersion is B (g), the water absorption ratio was calculated by the following formula.

$$\text{Water absorption ratio (times)}=(B)/(A) \quad (3)$$

[Fiber Processability]

According to a known manufacturing method, the fibers were opened with a roller card machine to form a web, and those that could be processed into non-woven fabrics were marked with OK, and those that could not be processed were marked with NG.

[Degree of Cross-Linking (Mol %)]

In the polyvinyl alcohol fiber into which a cross-linking component that forms an ether bond has been introduced, a measurement sample and a 1N hydroxylammonium chloride aqueous solution of 100 times the mass of the sample are placed in a test tube, sealed, and dissolved at 121° C. for 2 hours. The resulting solution was titrated with 0.1 N NaOH aqueous solution until the pH reached that of 1N hydroxylammonium chloride aqueous solution, and the degree of cross-linking was calculated from the titration amount by the following formula.

$$\text{Degree of cross-linking (mol \%)}=[\text{neutralized alkali amount (mol \%)}/(\text{PVA mass (g)}/44)]\times 1/2 \quad (4)$$

Example 1

A polyvinyl alcohol copolymer ("Elvanol 80-18" manufactured by Kuraray Co., Ltd.), which is a copolymer with methyl acrylate containing 5.2 mol % of an acrylic acid group, was dissolved in DMSO with stirring at 90° C. for 5 hours, and a spinning stock having a polyvinyl alcohol concentration of 22% by mass was obtained. This spinning stock solution was wet spun in a methanol/DMSO=80/20 solidifying bath at 10° C. through a nozzle with 40,000 holes and a hole diameter of 0.08 mmφ, and subjected to wet heat stretching of 3.0 times in a methanol bath at 20° C. Next, after extracting DMSO in the fiber with methanol, a spinning oil was applied and dried at 140° C. Next, the dry raw yarn obtained was subjected to dry heat stretching at 160° C. under the conditions of a dry heat stretching ratio of 2.0 times (total stretching ratio TD=6.0 times). Then, dry heat shrinkage was performed at 160° C. with a dry heat shrinkage rate of 1% to produce a polyvinyl alcohol water-retaining fiber. Table 1 shows the results of measuring the water absorption properties, tensile strength and water solubility temperature of the obtained fiber.

Example 2

A polyvinyl alcohol copolymer ("Elvanol T-25" manufactured by Kuraray Co., Ltd.), which is a copolymer with methyl methacrylate containing 2.5 mol % of methacrylic acid group, was dissolved in DMSO with stirring at 90° C. for 5 hours, and a spinning stock solution having a polyvinyl alcohol concentration of 20% by mass was obtained. This spinning stock solution was dry-wet spun in a methanol/DMSO 80/20 solidifying bath at 5° C. through a nozzle with 20 holes and a hole diameter of 0.15 mmφ, and subjected to wet heat stretching of 3.0 times in a methanol bath at 20° C. Next, after extracting DMSO in the fiber with methanol, a spinning oil was applied and dried at 120° C. Next, the dry raw yarn obtained was subjected to dry heat stretching at 180° C. under the conditions of a dry heat stretching ratio of 2.0 times (total stretching ratio TD=6.0 times). Then, dry heat shrinkage was performed at 180° C. with a dry heat shrinkage rate of 18 to produce a polyvinyl alcohol water-retaining fiber. Table 1 shows the results of measuring the water absorption properties, tensile strength and water solubility temperature of the obtained fiber.

Example 3

A polyvinyl alcohol copolymer ("K-5112" manufactured by Kuraray Co., Ltd.), which is a copolymer of monomethyl maleate containing 4.0 mol % of maleic acid group, was dissolved in DMSO with stirring at 90° C. for 5 hours, and a spinning stock solution having a polyvinyl alcohol concentration of 25% by mass was obtained. This spinning stock solution was dry-wet spun in a methanol/DMSO=80/20 solidifying bath at 5° C. through a nozzle with 80 holes and a hole diameter of 0.12 mmφ, and subjected to dry heat stretching of 3.0 times in a methanol bath at 20° C. Next, after extracting DMSO in the fiber with methanol, a spinning oil was applied and dried at 120° C. Next, the dry raw yarn obtained was subjected to dry heat stretching at 180° C. under the conditions of a dry heat stretching ratio of 2.0 times (total stretching ratio TD=6.0 times). Then, dry heat shrinkage was performed at 180° C. with a dry heat shrinkage rate of 1% to produce a polyvinyl alcohol water-retaining fiber. Table 1 shows the results of measuring the water absorption properties, tensile strength and water solubility temperature of the obtained fiber.

Example 4

A polyvinyl alcohol copolymer, which is a copolymer of 2-acrylamido-2-methylpropanesulfonic acid containing 2.0 mol % of sulfonic acid group, was dissolved in DMSO with stirring at 90° C. for 5 hours, and a spinning stock solution having a polyvinyl alcohol concentration of 21% by mass was obtained. This spinning stock solution was dry-wet spun in a methanol/DMSO=85/15 solidifying bath at 5° C. through a nozzle with 30000 holes and a hole diameter of 0.07 mmφ, and subjected to wet heat stretching of 3.0 times in a methanol bath at 20° C. Next, after extracting DMSO in the fiber with methanol, a spinning oil was applied and dried at 165° C. Next, the dry raw yarn obtained was subjected to dry heat stretching at 180° C. under the conditions of a dry heat stretching ratio of 2.67 times (total stretching ratio TD=8.0 times). Then, dry heat shrinkage was performed at 180° C. with a dry heat shrinkage rate of 18 to produce a polyvinyl alcohol water-retaining fiber. Table 1 shows the results of measuring the water absorption properties, tensile strength and water solubility temperature of the obtained fiber.

Example 5

A polyvinyl alcohol copolymer ("KL-118" manufactured by Kuraray Co., Ltd.), which is a copolymer with itaconic acid containing 1.5 mol % of itaconic acid group, was dissolved in DMSO with stirring at 90° C. for 5 hours, and a spinning stock solution having polyvinyl alcohol a concentration of 25% by mass was obtained. This spinning stock solution was dry-wet spun in a methanol/DMSO=80/20 solidifying bath at 5° C. through a nozzle with 80 holes and a hole diameter of 0.12 mmφ, and subjected to wet heat stretching of 3.0 times in a methanol bath at 20° C. Next, after extracting DMSO in the fiber with methanol, a spinning oil was applied and dried at 120° C. Next, the dry raw yarn obtained was subjected to dry heat stretching at 160° C. under the conditions of a dry heat stretching ratio of 2.0 times (total stretching ratio TD=6.0 times). Then, dry heat shrinkage was performed at 160° C. with a dry heat shrinkage rate of 18 to produce a polyvinyl alcohol water-retaining fiber. Table 1 shows the results of measuring the water absorption properties, tensile strength and water solubility temperature of the obtained fiber.

Comparative Example 1

A Polyvinyl alcohol ("22-88" manufactured by Kuraray Co., Ltd.) having no functional groups of sulfonic acid group, sulfonate group, maleic acid group, itaconic acid group, acrylic acid group and methacrylic acid group was dissolved in DMSO with stirring at 90° C. for 5 hours, and a spinning stock having solution a polyvinyl alcohol concentration of 22% by mass was obtained. This spinning stock solution was wet spun in a methanol/DMSO=80/20 solidifying bath at 10° C. through a nozzle with 40,000 holes and a hole diameter of 0.08 mmφ, and subjected to wet heat stretching of 3.0 times in a methanol bath at 20° C. Next, after extracting DMSO in the fiber with methanol, a spinning oil was applied and dried at 165° C. Next, the dry raw yarn obtained was subjected to dry heat stretching at 160° C. under the conditions of a dry heat stretching ratio of 2.0 times (total stretching ratio TD=6.0 times). Then, dry heat shrinkage was performed at 160° C. with a dry heat shrinkage rate of 1% to produce a polyvinyl alcohol water-retaining fiber. Table 1 shows the results of measuring the water absorption properties, tensile strength and water solubility temperature of the obtained fiber.

Comparative Example 2

A Polyvinyl alcohol copolymer, which is a copolymer with methyl acrylate containing 0.5 mol % of an acrylic acid group, was dissolved in DMSO with stirring at 90° C. for 5 hours, and a spinning stock solution having a polyvinyl, alcohol concentration of 19% by mass was obtained. This spinning stock solution was wet spun in a methanol/DMSO=80/20 solidifying bath at 10° C. through a nozzle with 40,000 holes and a hole diameter of 0.08 mmφ, and subjected to wet heat stretching of 3.0 times in a methanol bath at 20° C. Next, after extracting DMSO in the fiber with methanol, a spinning oil was applied and dried at 165° C. Next, the dry raw yarn obtained was subjected to dry heat stretching at 160° C. under the conditions of a dry heat stretching ratio of 2.0 times (total stretching ratio TD=6.0 times). Then, dry heat shrinkage was performed at 160° C. with a dry heat shrinkage rate of 18 to produce a polyvinyl alcohol water-retaining fiber. Table 1 shows the results of measuring the water absorption properties, tensile strength and water solubility temperature of the obtained fiber.

Comparative Example 3

A Polyvinyl alcohol copolymer, which is a copolymer with itaconic acid containing 0.5 mol % of itaconic acid group, was dissolved in DMSO with stirring at 90° C. for 5 hours, and a spinning stock solution having a polyvinyl alcohol concentration of 198 by mass was obtained. This spinning stock solution was wet spun in a solidifying bath of saturated sodium sulfate at 40° C. through a nozzle with 1,000 holes and a hole diameter of 0.08 mmφ, and the fiber thus formed were subjected to a wet heat stretching of 2.0 times and then applied with a spinning oil. Then, water in the fiber was dried at 130° C. to produce a polyvinyl alcohol fiber. Table 1 shows the results of measuring the water absorption properties, tensile strength and water solubility temperature of the obtained fiber.

Comparative Example 4

A Polyvinyl alcohol copolymer, which is a copolymer with itaconic acid containing 1.0 mol % of itaconic acid group, was dissolved in which water to 2 g/L of glutaraldehyde as a cross-linking agent had been added with stirring at 90° C. for 5 hours, and a spinning stock solution having a polyvinyl alcohol concentration of 15% by mass was obtained. This spinning stock solution was spun in an acidic coagulation bath containing a saturated mirabilite solution through a nozzle with 15,000 holes and a hole diameter of 0.16 mmφ for coagulation and cross-linking. Further, the fiber obtained was subjected to wet heat stretching at a roller draft of 3.0 times, washed with water, further dried at 130° C., and then subjected to dry heat stretching at a stretching ratio of 2.0 times at 170° C. Then, the fiber was subjected to dry heat shrinkage at 170° C. under the conditions of a dry heat shrinkage rate of 1% to produce a polyvinyl alcohol fiber having a degree of cross-linking of 0.07 mol %. Table 1 shows the results of measuring the water absorption properties, tensile strength and water solubility temperature of the obtained fiber.

Comparative Example 5

An ethylene-vinyl alcohol copolymer containing 5.0 mol % of ethylene group was dissolved in DMSO with stirring at 90° C. for 5 hours, and a spinning stock solution having a polyvinyl alcohol concentration of 19% by mass was obtained. This spinning stock solution was wet spun in a solidifying bath of saturated sodium sulfate at 40° C. through a nozzle with 1,000 holes and a hole diameter of 0.08 mmφ, and the fiber thus formed were subjected to a wet heat stretching of 2.0 times and then applied with a spinning oil. Then, water in the fiber was dried at 130° C. to produce a polyvinyl alcohol fiber. Table 1 shows the results of measuring the water absorption properties, tensile strength and water solubility temperature of the obtained fiber.

TABLE 1

| | Functional group type | Amount of functional group (mol %) | Degree of Saponification (mol %) | Cross-linking agent | Water absorption ratio (times) | Tensile strength (cN/dtex) | Crystallinity (%) | Processability | Dissolution temperature in water (° C.) |
|---|---|---|---|---|---|---|---|---|---|
| Example 1 | Acrylic acid group | 5.2 | 99.5 | None | 8.1 | 5.3 | 39.3 | OK | 40.2 |

TABLE 1-continued

| | Functional group type | Amount of functional group (mol %) | Degree of Saponification (mol %) | Cross-linking agent | Water absorption ratio (times) | Tensile strength (cN/dtex) | Crystallinity (%) | Processability | Dissolution temperature in water (° C.) |
|---|---|---|---|---|---|---|---|---|---|
| Example 2 | Methacrylic acid group | 2.5 | 99.5 | None | 6.8 | 5.9 | 45.5 | OK | 53.2 |
| Example 3 | Maleic acid group | 4.0 | 98.0 | None | 20.3 | 3.5 | 26.1 | OK | 60.5 |
| Example 4 | Sulfonic acid group | 2.0 | 98.0 | None | 10.0 | 4.6 | 29.2 | OK | 24.5 |
| Example 5 | Itaconic acid group | 1.5 | 97.0 | None | 5.7 | 6.2 | 49.0 | OK | 70.3 |
| Comparative Example 1 | None | — | 88.0 | None | Dissolved | 4.5 | 29.5 | OK | 15.2 |
| Comparative Example 2 | Acrylic acid group | 0.5 | 99.5 | None | 2.5 | 5.3 | 46.1 | OK | 75.1 |
| Comparative Example 3 | Itaconic acid group | 0.5 | 97.0 | None | 2.0 | 1.5 | 43.1 | NG | 85.0 |
| Comparative Example 4 | Itaconic acid group | 1.0 | 97.0 | Contained | 19.6 | 3.1 | 39.2 | OK | 95 or more |
| Comparative Example 5 | Ethylene group | 5.0 | 98.0 | None | 2.8 | 1.3 | 35.7 | NG | 65.3 |

As is clear from Table 1 above, the polyvinyl alcohol fiber of the present invention is excellent in water absorption properties, water solubility and mechanical strength.

The fiber structure containing the vinyl alcohol fiber of the present invention at least in part can be suitably used as a wound dressing material, a packaging material for soaps, detergents, bleaches and the like, a binder with glass non-woven fabric, and a disposable diaper.

What is claimed is:

1. A polyvinyl alcohol fiber, comprising:

1 mol % or more of at least one functional group selected from the group consisting of a sulfonic acid group, a sulfonate group, a maleic acid group, an itaconic acid group, an acrylic acid group, and a methacrylic acid group, wherein the polyvinyl alcohol fiber has a degree of cross-linking of 0% and a tensile strength of 3 cN/dtex or more and the polyvinyl alcohol fiber has a water absorption ratio of 5 times or more and 50 times or less after being immersed in physiological saline at 30° C. for 1 hour.

2. The polyvinyl alcohol fiber as claimed in claim 1, wherein the polyvinyl alcohol fiber has a dissolution temperature in physiological saline or water of 80° C. or less.

3. The polyvinyl alcohol fiber as claimed in claim 1, wherein the polyvinyl alcohol fiber has a degree of saponification of 95 mol % or more.

4. The polyvinyl alcohol fiber as claimed in claim 1, wherein the polyvinyl alcohol fiber has a crystallinity of 20 to 50%.

5. A fiber structure, comprising the polyvinyl alcohol fiber as claimed in claim 1 at least in part.

6. A method for producing the polyvinyl alcohol fiber as claimed in claim 1, the method comprising:

wet or dry-wet spinning a spinning stock solution containing polyvinyl alcohol in a solidifying bath mainly composed of an organic solvent capable of solidifying the polyvinyl alcohol to obtain a fiber, the polyvinyl alcohol comprising 1 mol % or more of at least one functional group selected from the group consisting of a sulfonic acid group, a sulfonate group, a maleic acid group, an itaconic acid group, an acrylic acid group, and a methacrylic acid group, wherein a total stretching ratio of the fiber, during a drying step, a stretching step, and/or a heating step, is 3 times or more.

* * * * *